US010066803B2

(12) United States Patent
Takada et al.

(10) Patent No.: US 10,066,803 B2
(45) Date of Patent: Sep. 4, 2018

(54) VEHICLE LAMP

(71) Applicant: Koito Manufacturing Co., Ltd., Tokyo (JP)

(72) Inventors: Ryo Takada, Shizuoka (JP); Kazuki Kajiyama, Shizuoka (JP); Takahito Osawa, Shizuoka (JP); Mamoru Kosuge, Shizuoka (JP); Kenji Yoshida, Shizuoka (JP); Masashi Katayama, Shizuoka (JP); Shuji Matsuura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 195 days.

(21) Appl. No.: 15/208,127

(22) Filed: Jul. 12, 2016

(65) Prior Publication Data

US 2016/0320012 A1 Nov. 3, 2016

Related U.S. Application Data

(63) Continuation of application No. PCT/JP2015/051225, filed on Jan. 19, 2015.

(30) Foreign Application Priority Data

Jan. 22, 2014 (JP) ..... 2014-009201
Dec. 2, 2014 (JP) ..... 2014-243735

(51) Int. Cl.
*F21S 41/29* (2018.01)
*F21S 41/143* (2018.01)
(Continued)

(52) U.S. Cl.
CPC ..... *F21S 41/295* (2018.01); *F21S 41/143* (2018.01); *F21S 41/27* (2018.01); *F21S 41/28* (2018.01);
(Continued)

(58) Field of Classification Search
CPC .. F21S 41/27; F21S 41/28; F21S 41/29; F21S 41/143; F21S 41/295; F21S 45/47; F21S 47/48; F21S 47/50
See application file for complete search history.

(56) References Cited

U.S. PATENT DOCUMENTS 8,100,569 B2 * 1/2012 Owada ..... B60Q 1/0683 362/520
8,366,305 B2 * 2/2013 Saito ..... F21K 9/00 362/549
2013/0250599 A1 9/2013 Owada

FOREIGN PATENT DOCUMENTS

CN 102798067 A 11/2012
JP H05-034617 A 2/1993
(Continued)

OTHER PUBLICATIONS

Office Action for corresponding CN application No. 201580003368.6, (dated Dec. 12, 2017), SIPO.
(Continued)

*Primary Examiner* — Stephen F Husar

(57) ABSTRACT

A vehicle lamp according to an aspect of the present invention includes a light source, a metal light-source stage including a light-source mounting portion, and a lens member that emits light from the light source toward the front of the lamp. The light-source stage includes a support portion for the lens member. The lens member includes a leg projecting toward the light-source stage and having an end that is supported by the support portion. The support portion includes three projections that abut the leg in a state in which the leg is supported by the support portion and position the lens member in a direction of an optical axis. The three projections are positioned relative to one another such that at least a portion of the light source lies in an extension range of a triangle with vertices given by the three projections.

5 Claims, 5 Drawing Sheets

(51) Int. Cl.

| | |
|---|---|
| ***F21S 41/20*** | (2018.01) |
| ***F21S 41/27*** | (2018.01) |
| ***F21S 45/47*** | (2018.01) |
| ***F21S 45/50*** | (2018.01) |
| ***F21S 45/48*** | (2018.01) |

(52) U.S. Cl.
CPC ..... *F21S 41/29* (2018.01); *F21S 45/47* (2018.01); *F21S 45/48* (2018.01); *F21S 45/50* (2018.01)

(56) References Cited

FOREIGN PATENT DOCUMENTS

| | | | |
|---|---|---|---|
| JP | H11-260103 | A | 9/1999 |
| JP | 2007-272039 | A | 10/2007 |
| JP | 2009-048903 | A | 3/2009 |
| JP | 2010-108637 | A | 5/2010 |
| JP | 2011-192549 | A | 9/2011 |
| JP | 2012-119285 | A | 6/2012 |
| JP | 2012-212653 | A | 11/2012 |
| JP | 2013-179172 | A | 9/2013 |
| JP | 2013-200992 | A | 10/2013 |

OTHER PUBLICATIONS

International Search Report from International Application No. PCT/JP2015/051225, dated Mar. 24, 2015.
International Preliminary Report on Patentability from International Application No. PCT/JP2015/051225, dated Mar. 24, 2015.
Office Action issued for the corresponding Japanese Patent Application No. 2015-558839, dated Jul. 10, 2018.

* cited by examiner

VEHICLE LAMP

CROSS-REFERENCE TO RELATED APPLICATIONS

This application is based upon and claims the benefit of priority from the prior Japanese Patent Application No. 2014-009201, filed on Jan. 22, 2014, Japanese Patent Application No. 2014-243735, filed on Dec. 2, 2014, and International Patent Application No. PCT/JP2015/051225, filed on Jan. 19, 2015, the entire content of each of which is incorporated herein by reference.

BACKGROUND OF THE INVENTION

1. Field of the Invention

The present invention relates to vehicle lamps and, in particular, relates to a vehicle lamp used in a vehicle, such as an automobile or a motorcycle.

2. Description of the Related Art

Patent document 1 discloses a vehicle lamp in which a front lens, including a lens cut unit, is fixed to a housing.

Patent Document 1 JP11-260103.

In the aforementioned vehicle lamp, light from a light source disposed in a lamp chamber is refracted by a lens portion and is then emitted. A desired light-distribution pattern is thus formed in front of the lamp.

It is the inventors' understanding that the accuracy with which light-distribution patterns are formed by conventional vehicle lamps can be improved.

SUMMARY OF THE INVENTION

The present invention has been made in view of such a situation and is directed to providing a technique for improving the accuracy with which a light-distribution pattern is formed by a vehicle lamp.

To solve the aforementioned problem, an aspect of the present invention includes a vehicle lamp. The vehicle lamp includes a light source, a metal light-source stage, including a light-source mounting portion, and a lens member that emits light from the light source toward a front of the lamp. The light-source stage includes a support portion for the lens member. The lens member includes a leg projecting toward the light-source stage and having an end that is supported by the support portion. The support portion includes three projections that abut the leg in a state in which the leg is supported by the support portion and position the lens member in a direction of an optical axis. The three projections are positioned relative to one another such that at least a portion of the light source lies in an extension range of a triangle with vertices given by the three projections.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1A:
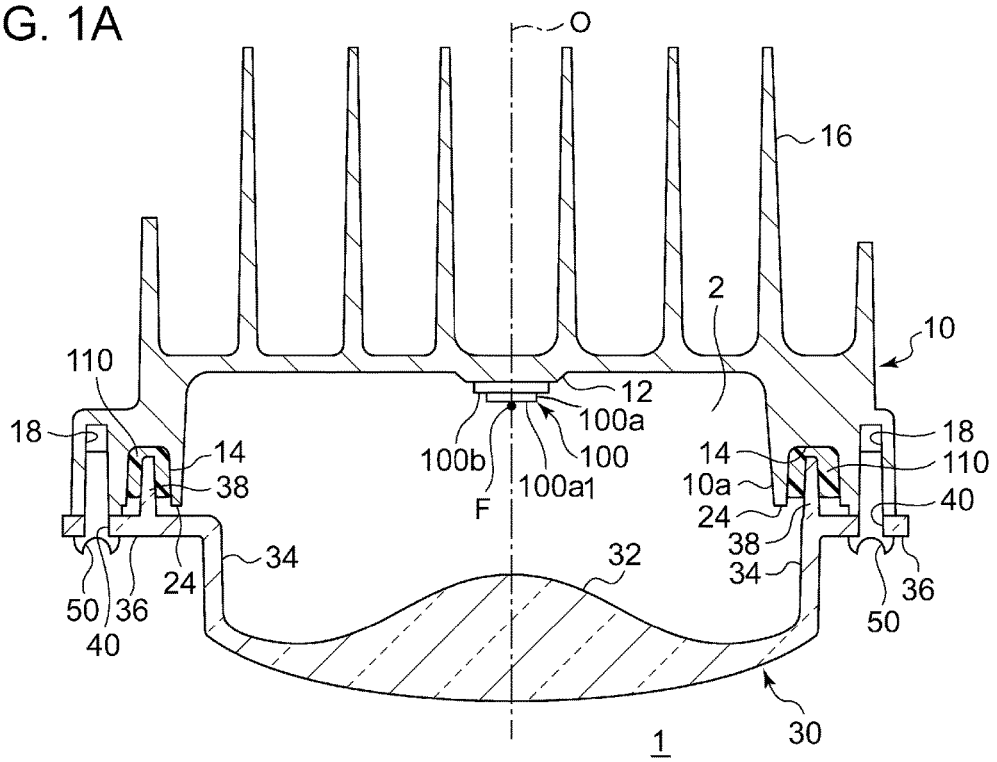
FIG. 1(A) is a horizontal sectional view illustrating a schematic structure of a vehicle lamp according to Embodiment 1.

An embodiment of the present invention includes a vehicle lamp. The vehicle lamp includes a light source, a metal light-source stage, including a light-source mounting portion, and a lens member that emits light from the light source toward a front of the lamp. The light-source stage includes a support portion for the lens member. The lens member includes a leg projecting toward the light-source stage and having an end that is supported by the support portion. The support portion includes three projections that abut the leg in a state in which the leg is supported by the support portion and position the lens member in a direction of an optical axis. The three projections are positioned relative to one another such that at least a portion of the light source lies in an extension range of a triangle with vertices given by the three projections. According to this aspect, the accuracy with which a light-distribution pattern is formed by the vehicle lamp can be improved.

In the foregoing aspect, the light source may include a light-emitting surface, the lens member may include a lens portion that refracts light from the light source disposed in a lamp chamber and that illuminates the front of the lamp with the light, and the lens portion may oppose the light-emitting surface. In addition, in either of the foregoing aspects, the lens member may include three projection-receiving surfaces which the three projections abut, and portions at which the projections abut the respective projection receiving surfaces may be at an equal distance in the direction of the optical axis from a predetermined reference point that determines a position of the light source relative to the light-source stage. With this configuration, the dimension control during the manufacture of the vehicle lamp can be simplified. In addition, in any one of the foregoing aspects, the light-source stage may include one of a first positioning mechanism and a second positioning mechanism that engage with each other in a state in which the leg is supported by the support portion, the lens member may include the other one of the first positioning mechanism and the second positioning mechanism provided on the leg, the first positioning mechanism may be a positioning pin, the second positioning mechanism may be a positioning hole into which the positioning pin is inserted, and, as the first positioning mechanism and the second positioning mechanism engage with each other, the light-source stage and the lens member may be positioned in a plane direction orthogonal to the direction of the optical axis of the vehicle lamp. In addition, in any one of the foregoing aspects, the light-source stage may be a lamp body that constitutes an outer shape of the vehicle lamp, and the lens member may be an outer cover that, along with the lamp body, constitutes the outer shape of the vehicle lamp. With these configurations as well, the accuracy with which a light-distribution pattern is formed by the vehicle lamp can be improved.

Hereinafter, preferred embodiments of the present invention will be described with reference to the drawings. The embodiments are not intended to limit the invention but are illustrative in nature. All of the features described in the embodiments and combinations thereof are not necessarily essential to the invention.

Embodiment 1

Figure 1B:
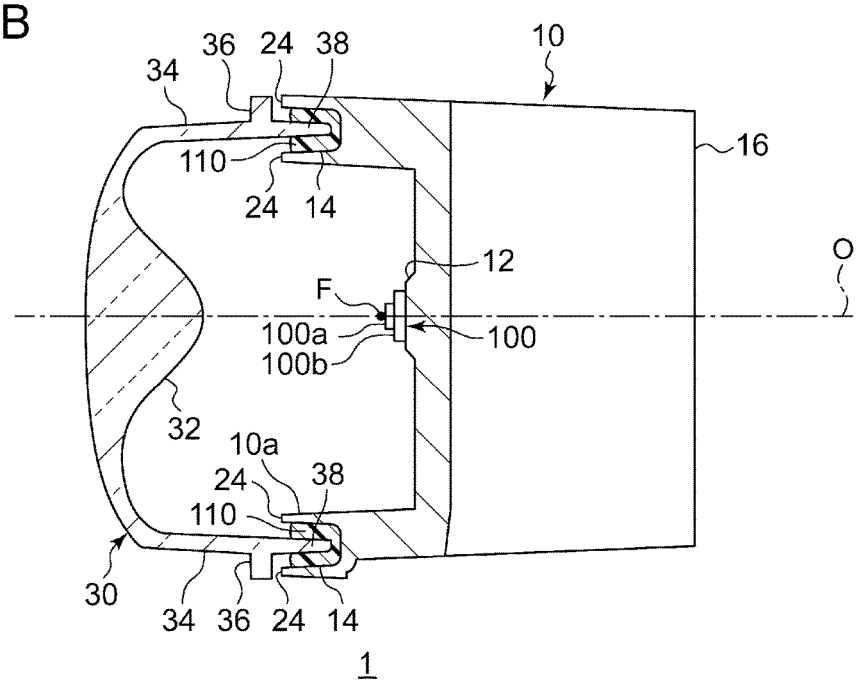
FIG. 1(B) is a vertical sectional view illustrating a schematic structure of the vehicle lamp according to Embodiment 1.
Figure 2A:
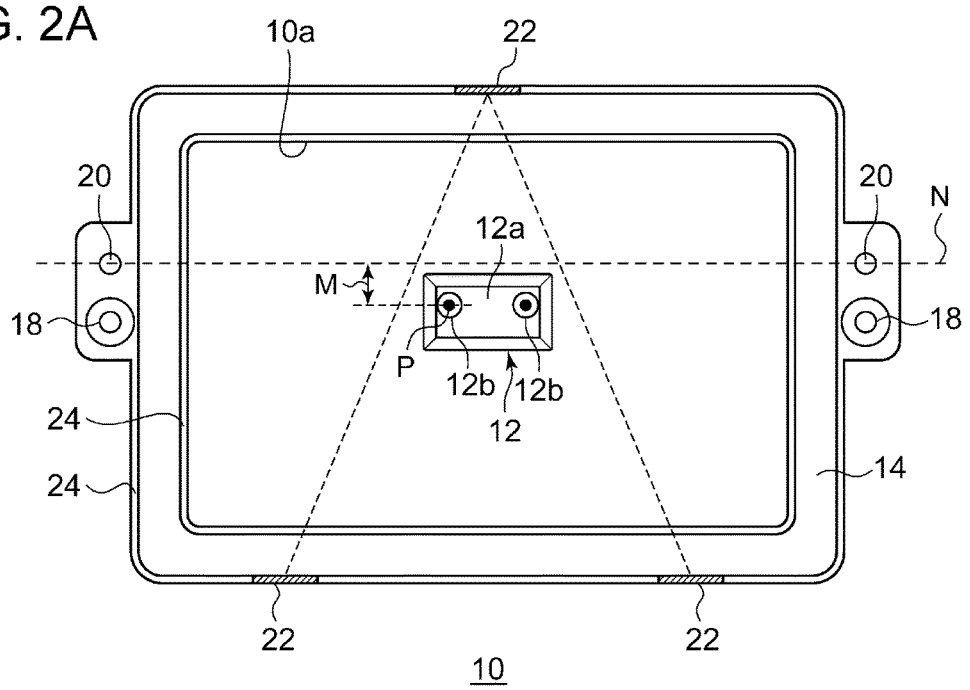
FIG. 2(A) is a front view illustrating a schematic structure of a lamp body.
Figure 2B:
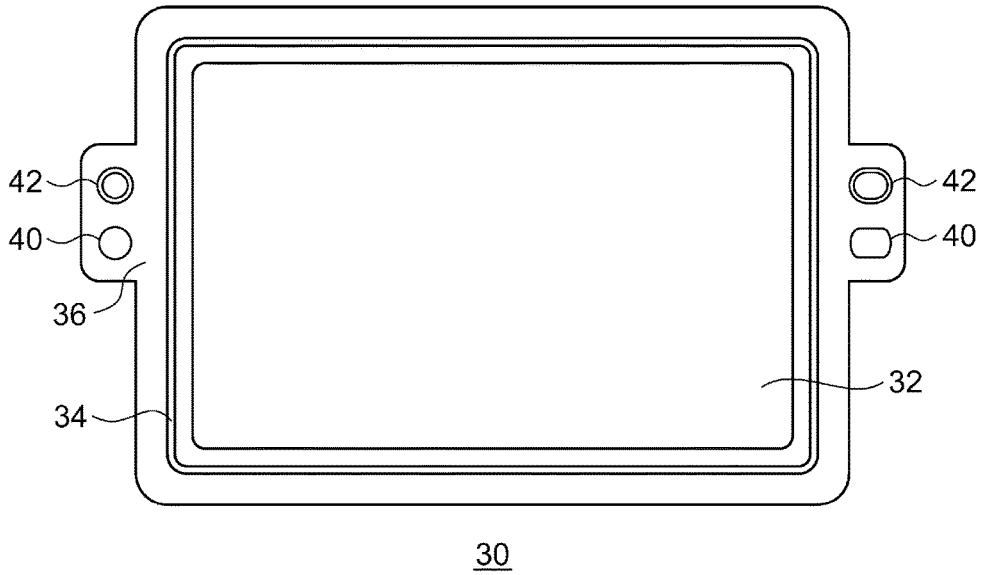
FIG. 2(B) is a front view illustrating a schematic structure of an outer cover.

FIG. 1(A) is a horizontal sectional view illustrating a schematic structure of a vehicle lamp according to Embodiment 1. FIG. 1(B) is a vertical sectional view illustrating a schematic structure of the vehicle lamp according to Embodiment 1. FIG. 2(A) is a front view illustrating a schematic structure of a lamp body. FIG. 2(B) is a front view illustrating a schematic structure of an outer cover. A vehicle lamp 1 according to the present embodiment includes a lamp body 10 having an opening 10*a* formed therein on a side facing toward the front of the vehicle and an outer cover 30 mounted so as to cover the opening 10*a* in the lamp body 10. As the outer cover 30 covers the opening 10*a*, a lamp chamber 2 is formed by the lamp body 10 and the outer cover 30. The vehicle lamp 1 is mounted to a vehicle body with an aiming mechanism (not illustrated) interposed therebetween.

The lamp body 10 includes a light-source mounting portion 12, a groove 14, a heat-dissipation fin 16, a tightening hole 18, a first positioning mechanism 20, and a projection 22. The lamp body 10 is made of metal and, for example, is a die-cast aluminum part, and has a structure in which the aforementioned components are integrally formed. The light-source mounting portion 12 includes a planar portion 12*a* that faces the front side of the lamp, and a light source 100 is mounted and fixed to the planar portion 12*a*. The light source 100 is constituted, for example, by a light-emitting module that includes a light-emitting element 100*a*, such as an LED, and a substrate 100*b* that supports the light-emitting element 100*a*. The light source 100 is disposed and mounted on the planar portion 12*a* such that a light-emitting surface 100*a*1 of the light-emitting element 100*a* faces toward the front of the lamp. A plurality of positioning pins 12*b* are provided on the planar portion 12*a* so as to project in a direction in which an optical axis O of the vehicle lamp 1 extends (hereinafter, referred to as the optical axis direction or direction of the optical axis, as appropriate), or in other words, in the depth-wise direction or front-back direction of the lamp. The positioning pins 12*b* are inserted into or engage with respective positioning holes (not illustrated) and positioning grooves (not illustrated) provided in the substrate 100*b*, and thus the light source 100 is positioned relative to the lamp body 10.

A plurality of heat-dissipation fins 16 are disposed on the back surface of the light-source mounting portion 12, or in other words, on the rear side of the lamp. Heat emitted by the light source 100 is conducted to the heat-dissipation fins 16 through the light-source mounting portion 12. Thus, the lamp body 10 constitutes the outer shape of the vehicle lamp 1 and also functions as a heat-dissipation member for the light source 100. In the present embodiment, the lamp body 10 is formed of aluminum that dissipates heat efficiently, and thus heat from the light source 100 can be diffused efficiently. The light source 100 may be an incandescent lamp, a halogen lamp, a discharge lamp, or the like.

The groove 14 is provided along the opening 10*a*. In the present embodiment, the groove 14 extends along the entire outer periphery of the opening 10*a*. To be more specific, a concave portion is formed in an end surface 24, which is an outer peripheral portion of the opening 10*a* and which faces toward the front of the lamp, or in other words, faces the outer cover 30, and this concave portion constitutes the groove 14. A plurality of tightening holes 18 and a plurality of first positioning mechanisms 20 are disposed on the outer side of the groove 14. In the present embodiment, two tightening holes 18 are arrayed in the widthwise direction or horizontal direction of the lamp with the light-source mounting portion 12 interposed therebetween. In addition, two first positioning mechanisms 20 are set in an array in the horizontal direction of the lamp with the light-source mounting portion 12 interposed therebetween. The peripheral portion of the opening 10*a* that includes the groove 14 and the end surface 24 constitutes a support portion for the outer cover 30.

The tightening holes 18 extend in the optical axis direction. The first positioning mechanisms 20 according to the present embodiment are positioning pins and project in the optical axis direction of the vehicle lamp 1 toward the front of the lamp (see FIG. 3(A) and FIG. 4). A plurality of projections 22 are provided on the end surface 24 of the lamp body 10. The projections 22 are ribs that project in the optical axis direction of the vehicle lamp 1 (see FIG. 3(B) and FIG. 4).

The outer cover 30 is a member for emitting light from the light source 100 toward the front of the lamp and includes a lens portion 32, a leg 34, a flange 36, an engagement portion 38, a tightening hole 40, and a second positioning mechanism 42. The outer cover 30 is formed, for example, of a translucent resin and has a structure in which the aforementioned components are integrally formed. The outer cover 30, along with the lamp body 10, constitutes the outer shape of the vehicle lamp 1. The lens portion 32 has a thick lens shape and has an optical function of refracting light from the light source 100 disposed in the lamp chamber 2 and illuminating the front of the lamp with the light. In other words, a desired light-distribution pattern can be formed in front of the lamp by the lens portion 32. The lens portion 32 has a focal point F on the rear side of the lamp and the lens portion 32 is disposed such that the focal point F lies on the light-emitting surface 100*a*1 of the light-emitting element 100*a*.

The leg 34 extends from the periphery of the lens portion 32 toward the lamp body 10. The flange 36 and the engagement portion 38 are provided at an end of the leg 34. The flange 36 and the engagement portion 38 partially constitute the leg 34. Part of the engagement portion 38 is coupled to a portion of the leg 34 that extends toward the lamp body 10 with the flange 36 interposed therebetween. The engagement portion 38 projects from the leg 34 in the optical axis direction and extends along the entire outer periphery of the lens portion 32. As the engagement portion 38 is inserted into the groove 14 in the lamp body 10, the lamp body 10 and the outer cover 30 are fixed to each other. The fixation of the lamp body 10 and the outer cover 30 will be described later in detail. The flange 36 extends in a direction substantially orthogonal to the optical axis direction from an outer side surface of a portion of the leg 34 that extends toward the lamp body 10. A side of the flange 36 toward the rear side of the lamp, or in other words, a side that faces the lamp body 10 includes a projection-receiving surface 36*a* against which a projection 22 abuts in a state in which the engagement portion 38 is inserted in the groove 14. A plurality of tightening holes 40 and a plurality of second positioning mechanisms 42 are disposed on the flange 36. In the present embodiment, two tightening holes 40 are set in an array in the horizontal direction of the lamp with the lens portion 32 interposed therebetween. In addition, two second positioning mechanisms 42 are set in an array in the horizontal direction of the lamp with the lens portion 32 interposed therebetween.

The tightening holes 40 penetrate the flange 36 in the optical axis direction and are disposed so as to overlap the tightening holes 18 in the lamp body 10 in a state in which the engagement portion 38 is inserted in the groove 14. One of the two tightening holes 40 is a substantially circular hole, and the other one of them is a long hole. Since one of the tightening holes 40 is a long hole, errors in the dimensions of the lamp body 10 and the outer cover 30 can be absorbed. The second positioning mechanisms 42 according to the present embodiment are positioning holes into which the positioning pins served by the first positioning mechanisms 20 of the lamp body 10 are inserted. The second positioning mechanisms 42 penetrate the flange 36 in the optical axis direction and are disposed so as to engage with the first positioning mechanisms 20 of the lamp body 10 in a state in which the engagement portion 38 is inserted in the groove 14. One of the two second positioning mechanisms 42 is a substantially circular hole, and the other one of them is a long hole. Since one of the second positioning mechanisms 42 is a long hole, errors in the dimensions of the lamp body 10 and the outer cover 30 can be absorbed.

Figure 3A:
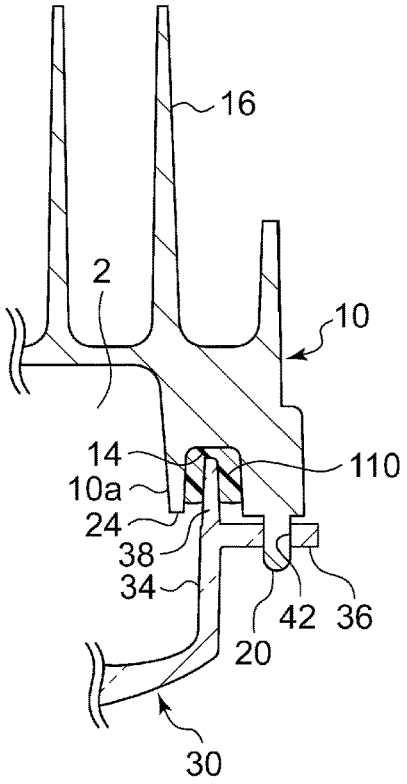
FIG. 3(A) is a horizontal sectional view of the vehicle lamp taken along a position passing through a portion at which a first positioning mechanism and a second positioning mechanism engage with each other.
Figure 3B:
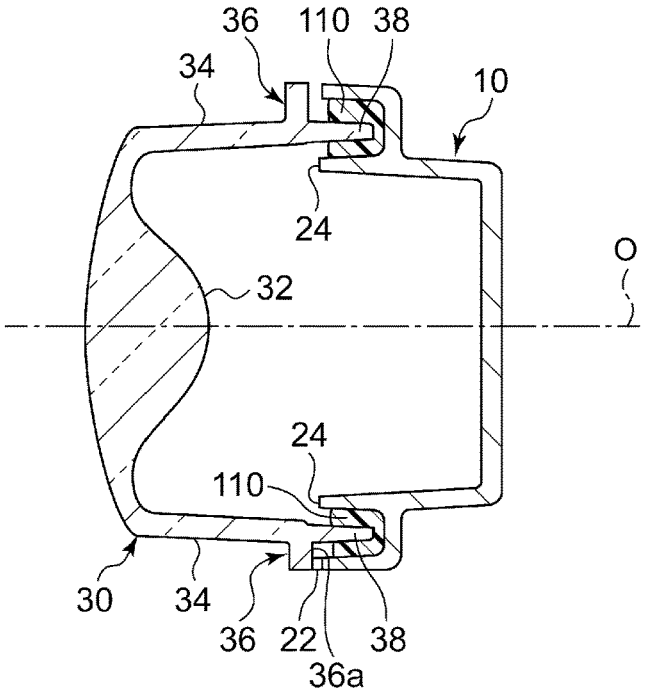
FIG. 3(B) is a vertical sectional view of the vehicle lamp taken along a position passing through a portion at which a projection abuts against a projection-receiving surface.
Figure 4:
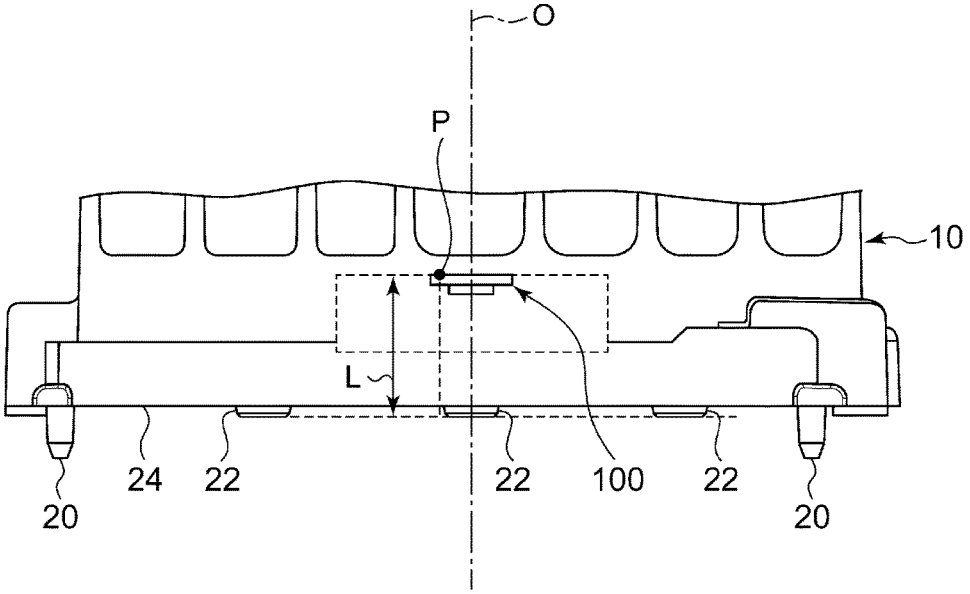
FIG. 4 is a planar view of a lamp body at a portion near an end surface thereof.

The fixation and the positioning of the lamp body 10 and the outer cover 30 will now be described in detail. FIG. 3(A) is a horizontal sectional view of the vehicle lamp taken along a position passing through a portion at which the first positioning mechanism and the second positioning mechanism engage with each other. FIG. 3(B) is a vertical sectional view of the vehicle lamp taken along a position passing through a portion at which a projection abuts against a projection-receiving surface. FIG. 3(A) illustrates only the first positioning mechanism 20 and the second positioning mechanism 42 provided on one side. The first positioning mechanism 20 and the second positioning mechanism 42 provided on the other side have a similar configuration, and thus illustration thereof will be omitted. FIG. 4 is a planar view of the lamp body at a portion near the end surface. In FIG. 4, a region enclosed by the dashed line illustrates the inside of the opening 10*a*.

The lamp body 10 and the outer cover 30 are fixed to each other with the engagement portion 38 inserted in the groove 14. To be more specific, an adhesive 110, such as a thermosetting adhesive, is first injected into the groove 14. Then, the engagement portion 38 is inserted into the groove 14 before the adhesive 110 sets. With the engagement portion 38 inserted in the groove 14, tightening members 50, such as screws, are inserted into the tightening holes 40 in the outer cover 30 and the tightening holes 18 in the lamp body 10 that overlap each other. The lamp body 10 and the outer cover 30 are tentatively fixed to each other by the tightening members 50. Thereafter, the adhesive 110 is set, and thus the lamp body 10 and the outer cover 30 are fully fixed to each other. Thus, the lamp body 10 and the outer cover 30 are fixed to each other by the adhesive 110 and the tightening members 50. In this manner, fixing the lamp body 10 and the outer cover 30 to each other by the tightening members 50 before the adhesive 110 sets makes it possible to prevent the lamp body 10 and the outer cover 30 from being misaligned before and while the adhesive 110 sets. As the engagement portion 38 is inserted in the groove 14 and fixed therein, the lamp chamber 2 is sealed, and the lamp chamber 2 can be kept watertight.

The first positioning mechanisms 20 and the second positioning mechanisms 42 engage with each other in a state in which the engagement portion 38 is inserted in the groove 14. Specifically, the positioning pins constituting the first positioning mechanisms 20 are inserted into the positioning holes constituting the second positioning mechanisms 42. As the first positioning mechanisms 20 and the second positioning mechanisms 42 engage with each other, the lamp body 10 and the outer cover 30 are positioned in a plane direction orthogonal to the optical axis direction. In other words, the lamp body 10 and the outer cover 30 are positioned in the heightwise direction or vertical direction and the horizontal direction of the lamp.

In a state in which the engagement portion 38 is inserted in the groove 14, the projections 22 abut the projection-receiving surfaces 36*a*, and the lamp body 10 and the outer cover 30 are thus positioned in the optical axis direction. Thus, the leg 34 of the outer cover 30 that includes the projection-receiving surfaces 36*a* and the engagement portion 38 has a function of sealing the lamp chamber 2 and a function of positioning the lamp body 10 and the outer cover 30.

When the lamp body 10 and the outer cover 30 are positioned in all of the front-back direction, the horizontal direction, and the vertical direction of the lamp, the lens portion 32 is located on the optical axis O, and the focal point F is positioned to the light-emitting surface 100*a*1 of the light-emitting element 100*a* with high accuracy. Light emitted by the light-emitting element 100*a* is incident on the lens portion 32, is deflected in a predetermined direction, and illuminates the front of the lamp through the outer cover 30. With this configuration, a desired light-distribution pattern can be formed in front of the lamp with high accuracy. The vehicle lamp 1 according to the present embodiment is a so-called direct-lighting lamp, in which the light-emitting surface 100*a*1 of the light source 100 faces toward the front of the lamp, the lens portion 32 opposes the light-emitting surface 100*a*1, and light from the light source is directly incident on the lens portion 32. The vehicle lamp 1 may instead be a so-called reflection-type lamp, in which light from the light source is reflected by a reflector and the reflected light is incident on the lens portion 32.

The vehicle lamp 1 according to the present embodiment includes a plurality projections 22 and a plurality of projection-receiving surfaces 36*a*. Specifically, the vehicle lamp 1 includes three projections 22 and three projection-receiving surfaces 36*a*. With regard to the projection-receiving surfaces 36*a*, on a side of the flange 36 that faces the lamp body 10, regions against which the projections 22 abut constitutes the projection-receiving surfaces 36*a*. Then, as illustrated in FIG. 4, portions at which the projections 22 abut the respective projection-receiving surfaces 36*a*, or in other words, the top surfaces of the projections 22 are disposed at an equal distance L in the optical axis direction from a predetermined reference point P that determines the position of the light source 100 relative to the lamp body 10. In other words, the top surfaces of the three projections 22 lie on the same plane, and this plane is orthogonal to the optical axis O.

The reference point P can, for example, be the projection position of one of the positioning pins 12*b* provided on the light-source mounting portion 12. Alternatively, the reference point P may be set on the light source 100, such as the center of the light-emitting surface 100*a*1 of the light-emitting element 100*a*. When the vehicle lamp 1 is manufactured, the dimensions of the components of the lamp body 10 or the outer cover 30 are controlled in accordance with the distance from the reference point P. Accordingly, by designing such that the top surfaces of the projections 22 are disposed on the same plane and the stated plane is parallel to the planar portion 12*a* of the light-source mounting portion 12, the distance between the top surface of each projection 22 and the planar portion 12*a* can be made equal, and thus the distance L between each top surface and the reference point P in the optical axis direction can be made equal. With this configuration, the dimensions for the arrangement of the projections 22 can be made uniform, and the dimension control during the manufacture of the vehicle lamp 1 can be simplified.

In addition, as illustrated in FIG. 2(A), the three projections 22 are positioned relative to one another such that at least a portion of the light source 100 lies in an extension range of a triangle with vertices given by the three projections 22 as viewed from the front of the lamp. With this configuration, the projections 22 are evenly disposed around the light source 100 as viewed from the front of the lamp, and thus the light source 100 mounted on the lamp body 10 and the lens portion 32 of the outer cover 30 can be positioned in the optical axis direction with higher accuracy. The vehicle lamp 1 according to the present embodiment has a structure in which the lens portion 32 opposes the light-emitting surface 100*a*1 of the light source 100, and thus it is important to position the lamp body 10 and the outer cover 30 in the optical axis direction with high accuracy. It is preferable that the three projections 22 be positioned relative to one another such that the center of gravity of the light source 100 is located inside the aforementioned triangle.

Furthermore, as illustrated in FIG. 2(A), the two first positioning mechanisms 20 are disposed at an equal distance M from the predetermined reference point P that determines the position of the light source 100 relative to the lamp body 10 in the vertical direction of the lamp orthogonal to the optical axis direction (direction orthogonal to the direction in which the two first positioning mechanisms 20 are set in an array). With this configuration, the dimensions of the plurality of first positioning mechanisms 20 can be made uniform, and thus the dimension control during the manufacture of the vehicle lamp 1 can be simplified. It is to be noted that, when the first positioning mechanisms 20 are set in an array in the vertical direction of the lamp with the light-source mounting portion 12 interposed therebetween, the two first positioning mechanisms 20 are disposed at an equal distance M from the reference point P in the horizontal direction of the lamp orthogonal to the optical axis direction, and thus the dimension control can be simplified. In addition, it is preferable that each of the first positioning mechanisms 20 be disposed such that the reference point P lies on a straight line N connecting the two first positioning mechanisms 20. In other words, by setting the distance M to 0, the dimension control can be further simplified.

As illustrated in FIG. 4, the end surface 24 of the lamp body 10 is disposed at an equal distance from the reference point P in the optical axis direction. In other words, the end surface 24 is contained within a single plane, and this plane is orthogonal to the optical axis O. With this configuration as well, the dimension control can be simplified. In addition, the end surface 24 and the flange 36 extend in parallel to each other. With this configuration, the dimension control can be simplified, and the lamp chamber 2 can be sealed more securely by the groove 14 and the engagement portion 38.

It is preferable that at least one of the inner surface and the outer surface of the leg 34 of the outer cover 30 be subjected to a surface treatment for reducing light leaking from the lamp chamber 2 to the outside through the leg 34 or reducing light entering the lamp chamber 2 from the outside. Examples of such a surface treatment include applying a colored paint, depositing metal, roughening treatment, and forming a light-diffusing step. Examples of forming a light-diffusing step include arraying a plurality of cylindrical steps on the surface of the leg 34. Carrying out such a surface treatment can reduce light from the light source 100 leaking to the outside through the leg 34, and thus the possibility of glare affecting others can be reduced. In particular, when the vehicle lamp 1 is mounted in a motorcycle, the possibility of glare affecting the driver can be reduced. In addition, carrying out the above-described surface treatment can prevent the sunlight from entering the lamp chamber 2, and thus a rise in the temperature of the light source 100 can be suppressed.

As described thus far, in the vehicle lamp 1 according to the present embodiment, the lamp body 10 includes the first positioning mechanisms 20, and the outer cover 30 includes the second positioning mechanisms 42. The first positioning mechanisms 20 and the second positioning mechanisms 42 engage with each other in a state in which the engagement portion 38 of the outer cover 30 is inserted in the groove 14 in the lamp body 10. With this configuration, the lens portion 32 of the outer cover 30 and the light source 100 mounted on the lamp body 10 can be positioned relative to each other with high accuracy. Accordingly, the accuracy with which a light-distribution pattern is formed by the vehicle lamp 1 can be improved. In addition, the relative positions of the lamp body 10 and the outer cover 30 can be retained with high accuracy even with a combination of members having different coefficients of thermal expansion such as the combination of the lamp body 10 made of metal and the outer cover 30 made of resin. Therefore, while the accuracy with which a light-distribution pattern is formed by the vehicle lamp 1 is retained, the lamp body 10 made of metal enables the heat dissipation efficiency of the light source 100 to be improved, and the outer cover 30 made of resin enables the manufacturing process of the vehicle lamp 1 to be simplified and the cost of the vehicle lamp 1 to be reduced.

In addition, the first positioning mechanisms are the positioning pins, and the second positioning mechanisms are the positioning holes into which the positioning pins are inserted. As the first positioning mechanisms and the second positioning mechanisms engage with each other, the lamp body and the outer cover are positioned in the plane direction orthogonal to the optical axis direction of the vehicle lamp. With this configuration, the relative positions of the lamp body 10 and the outer cover 30 in the vertical direction and the horizontal direction of the lamp can be determined with high accuracy. In addition, the lamp body 10 and the outer cover 30 can be positioned by a simple structure. Furthermore, the lamp body 10 includes the projections 22, and the outer cover 30 includes the projection-receiving surfaces 36*a* that engage with the projections 22. With this configuration, the relative positions of the lamp body 10 and the outer cover 30 in the front-back direction of the lamp can be determined with high accuracy.

Embodiment 2

A vehicle lamp according to Embodiment 2 has the same configuration as that of Embodiment 1 except in that a lamp body and an outer cover are provided on the outer side of the vehicle lamp 1 according to Embodiment 1. Hereinafter, the vehicle lamp according to Embodiment 2 will be described while the description centers on configurations different from those of Embodiment 1.

Figure 5:
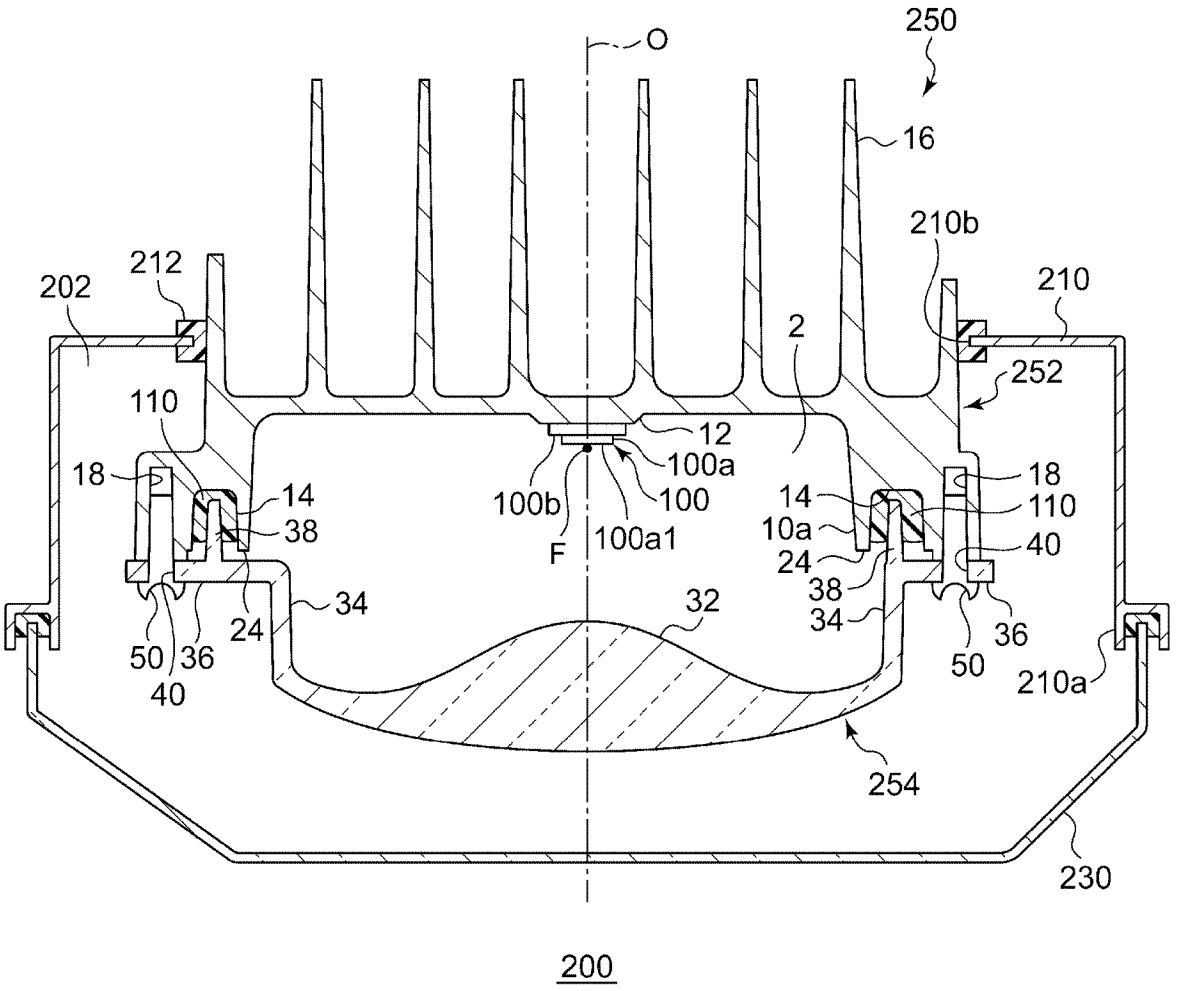
FIG. 5 is a horizontal sectional view illustrating a schematic structure of a vehicle lamp according to Embodiment 2.

FIG. 5 is a horizontal sectional view illustrating a schematic structure of the vehicle lamp according to Embodiment 2. A vehicle lamp 200 according to the present embodiment includes a lamp body 210 and an outer cover 230. The lamp body 210 includes an opening 210*a* at the front side of the vehicle and an opening 210*b* at the rear side of the vehicle. The outer cover 230 is mounted so as to cover the opening 210*a*. A lamp unit 250 is housed in a lamp chamber 202 constituted by the lamp body 210 and the outer cover 230. The lamp unit 250 is housed in the lamp chamber 202 such that heat-dissipation fins 16 are exposed to the outside through the opening 210*b*.

The lamp body 210 and the outer cover 230 are fixed to each other, for example, through a method similar to the method of fixing the lamp body 10 and the outer cover 30 to each other in Embodiment 1. In other words, an adhesive, such as a thermosetting adhesive, is injected into a groove provided along the opening 210*a* in the lamp body 210. Then, the tip of a leg of the outer cover 230 that extends toward the lamp body 210 is inserted into the groove before the adhesive sets. Thereafter, the lamp body 210 and the outer cover 230 are fixed to each other as the adhesive is set. In addition, the opening 210*b* in the lamp body 210 and the lamp unit 250 are fixed to each other by a sealing member 212, such as an O-ring, with the sealing member 212 interposed therebetween. The leg of the outer cover 230 is inserted into the groove in the lamp body 210 and is then fixed with an adhesive, and the lamp unit 250 is fixed to the lamp body 210 with the sealing member 212 interposed therebetween. Thus, the lamp chamber 202 is sealed, and the lamp chamber 202 can be kept watertight.

The lamp unit 250 has the same configuration as that of the vehicle lamp 1 according to Embodiment 1. However, in the vehicle lamp 200, the lamp body 210 and the outer cover 230 are provided on the outer side of the lamp unit 250. Therefore, the lamp body 10 according to Embodiment 1 serves as a light-source stage 252 in Embodiment 2. In addition, the outer cover 30 according to Embodiment 1 serves as a lens member 254 in Embodiment 2.

Similarly to the lamp body 10 according to Embodiment 1, the light-source stage 252 includes a light-source mounting portion 12, a groove 14, the heat-dissipation fins 16, a tightening hole 18, a first positioning mechanism 20 (see FIG. 2(A)), and a projection 22 (see FIG. 2(A)). The light-source stage 252 is made of metal and, for example, is a die-cast aluminum part, and has a structure in which the aforementioned components are integrally formed. The structures of the light-source mounting portion 12, the groove 14, the heat-dissipation fins 16, the tightening hole 18, the first positioning mechanism 20, and the projection 22 are similar to those in Embodiment 1.

The peripheral portion of the opening 10*a* that includes the groove 14 and an end surface 24 corresponds to a support portion for the lens member 254. Three projections 22 are provided on the support portion for the lens member 254, or to be more specific, on the end surface 24. The three projections 22 abut a leg 34, or to be more specific, against projection-receiving surfaces 36*a* (see FIG. 3(B)) in a state in which the leg 34 is supported by the support portion and position the lens member 254 in the optical axis direction. As illustrated in FIG. 2(A), the three projections 22 are positioned relative to one another such that at least a portion of a light source 100 lies in an extension range of a triangle with vertices given by the three projections 22. It is preferable that the three projections 22 be positioned relative to one another such that the center of gravity of the light source 100 is located inside the aforementioned triangle.

The lens member 254 is a member for emitting light from the light source 100 toward the front of the lamp and includes a lens portion 32, the leg 34, a flange 36, an engagement portion 38, a tightening hole 40, and a second positioning mechanism 42 (see FIG. 2(B)), similarly to the outer cover 30 according to Embodiment 1. The lens member 254 is formed, for example, of a translucent resin, and has a structure in which the aforementioned components are integrally formed. The lens member 254 is disposed such that the lens portion 32 that refracts light from the light source 100 and illuminates the front of the lamp with the light opposes a light-emitting surface 100*a*1 of the light source 100. In the vehicle lamp 200 according to the present embodiment, a light-distribution pattern is formed by the lens portion 32, and the outer cover 230 does not have an optical function of forming a light-distribution pattern. The structures of the lens portion 32, the leg 34, the flange 36, the engagement portion 38, the tightening hole 40, and the second positioning mechanism 42 are similar to those in Embodiment 1. The flange 36 and the engagement portion 38 partially constitute the leg 34. The leg 34 extends toward the light-source stage 252, and an end of the leg 34, or to be more specific, the engagement portion 38 is supported by the groove 14 serving as a support portion.

The lens member 254 includes three projection-receiving surfaces 36*a* (see FIG. 3(B)) against which the three projections 22 abut, and the three projection-receiving surfaces 36*a* are provided on a side of the flange 36 that faces the light-source stage 252. Portions at which the projections 22 abut the respective projection-receiving surfaces 36*a* are disposed at an equal distance L in the optical axis direction from a predetermined reference point P (see FIG. 4) that determines the position of the light source 100 relative to the light-source stage 252.

In the present embodiment as well, as in Embodiment 1, the first positioning mechanism 20 is a positioning pin, and the second positioning mechanism 42 is a positioning hole into which the positioning pin is inserted (see FIG. 3(A)). As the first positioning mechanism 20 and the second positioning mechanism 42 engage with each other, the light-source stage 252 and the lens member 254 are positioned in a plane direction orthogonal to the optical axis direction of the vehicle lamp 200.

With the vehicle lamp 200 according to the present embodiment as well, as in Embodiment 1, the lens portion 32 of the lens member 254 and the light source 100 mounted on the light-source stage 252 can be positioned relative to each other with high accuracy. Accordingly, the accuracy with which a light-distribution pattern is formed by the vehicle lamp 200 can be improved. In addition, the relative positions of the light-source stage 252 and the lens member 254 can be retained with high accuracy even with a combination of members having different coefficients of thermal expansion such as the combination of the light-source stage 252 made of metal and the lens member 254 made of resin. Therefore, while the accuracy with which a light-distribution pattern is formed by the vehicle lamp 200 is retained, the light-source stage 252 made of metal enables the heat dissipation efficiency of the light source 100 to be improved, and the lens member 254 made of resin enables the manufacturing process of the vehicle lamp 200 to be simplified and the cost of the vehicle lamp 200 to be reduced.

In addition, the first positioning mechanism 20 is the positioning pin, and the second positioning mechanism 42 is the positioning hole. As the first positioning mechanism 20 and the second positioning mechanism 42 engage with each other, the light-source stage 252 and the lens member 254 are positioned in the plane direction orthogonal to the optical axis direction of the vehicle lamp 200. With this configuration, the relative positions of the light-source stage 252 and the lens member 254 in the vertical direction and the horizontal direction of the lamp can be determined with high accuracy. In addition, the light-source stage 252 and the lens member 254 can be positioned by a simple structure. Furthermore, the light-source stage 252 includes the projections 22, and the lens member 254 includes the projection-receiving surfaces 36*a*. With this configuration, the relative positions of the light-source stage 252 and the lens member 254 in the front-back direction of the lamp can be determined with high accuracy.

The present invention is not limited to the foregoing embodiments. Further modifications, including various design changes, can also be made on the basis of the knowledge of a person skilled in the art, and an embodiment with such modifications is also encompassed within the scope of the present invention. A new embodiment arising from a combination of the foregoing embodiments and modifications thereof has effects of both the combined embodiments and modifications thereof.

In Embodiment 1 described above, the groove 14 is provided in the lamp body 10, and the engagement portion 38 is provided in the outer cover 30. Alternatively, the engagement portion 38 may be provided in the lamp body 10, and the groove 14 may be provided in the outer cover 30. In other words, the vehicle lamp 1 has a structure in which one of the groove 14 and the engagement portion 38 is provided in the lamp body 10 and the other one of the two is provided in the outer cover 30. In addition, in Embodiment 1 described above, the first positioning mechanisms 20 are provided in the lamp body 10, and the second positioning mechanisms 42 are provided in the outer cover 30. Alternatively, the second positioning mechanisms 42 may be provided in the lamp body 10, and the first positioning mechanisms 20 may be provided in the outer cover 30. In other words, the vehicle lamp 1 has a structure in which one of the first positioning mechanisms 20 and the second positioning mechanisms 42 is provided in the lamp body 10 and the other one of the two is provided in the outer cover 30.

In Embodiment 1, the projections 22 are provided on the lamp body 10, and the projection-receiving surfaces 36*a* are provided on the outer cover 30. Alternatively, the projection-receiving surfaces 36*a* may be provided on the lamp body 10, and the projections 22 may be provided on the outer cover 30. In other words, the vehicle lamp 1 has a structure in which one of the projections 22 and the projection-receiving surfaces 36*a* is provided on the lamp body 10 and the other one of the two is provided on the outer cover 30. In addition, the number of the first positioning mechanisms 20 and the number of the second positioning mechanisms 42 are not particularly limited and may each be one or three or more. In a similar manner, the number of the projections 22 and the number of the projection-receiving surfaces 36*a* are not particularly limited and may each be one, two, or four or more. It is preferable that the number of combinations of the first positioning mechanism 20 and the second positioning mechanism 42 and the number of combinations of the projection 22 and the projection-receiving surface 36*a* be plural.

In Embodiment 1 described above, the adhesive 110, such as a thermosetting adhesive, is injected into the groove 14, and the engagement portion 38 is inserted into the groove 14 before the adhesive 110 sets. The lamp body 10 and the outer cover 30 are then fixed to each other, and thus the lamp chamber 2 is sealed. The present invention is not particularly limited to this configuration. For example, the lamp body 10 and the outer cover 30 may be fixed to each other with a sealing member, such as an O-ring, interposed therebetween. Thus, the lamp chamber 2 may be sealed, and the lamp chamber 2 may be kept watertight.

The modifications described above also apply in Embodiment 2. In addition, in Embodiment 2, the lamp body 210 and the outer cover 230 are fixed to each other with an adhesive, but the present invention is not particularly limited to this configuration. The lamp body 210 and the outer cover 230 may be fixed to each other with a sealing member, such as an O-ring, interposed therebetween. In this case as well, the lamp chamber 202 can be kept watertight.

The lamp body 10 in the vehicle lamp 1 according to Embodiment 1 can be seen as the light-source stage 252 according to Embodiment 2 provided with a function of constituting the outer shape of the vehicle lamp 1. In other words, in Embodiment 1, the light-source stage is the lamp body. In addition, the outer cover 30 in the vehicle lamp 1 according to Embodiment 1 can be seen as the lens member 254 according to Embodiment 2 provided with a function of constituting the outer shape of the vehicle lamp 1. In other words, in Embodiment 1, the lens member is the outer cover.

Accordingly, configurations common to the vehicle lamp 1 according to Embodiment 1 and the vehicle lamp 200 according to Embodiment 2 described above can be the configurations indicated in the following items 1 through 4. Item 5 is a configuration in a case in which the configurations in the items 1 through 4 are specific to Embodiment 1.

1. A vehicle lamp, comprising:

a light source;

a metal light-source stage including a light-source mounting portion; and a lens member that emits light from the light source toward a front of the lamp, wherein the light-source stage includes a support portion for the lens member, wherein the lens member includes a leg projecting toward the light-source stage and having an end that is supported by the support portion, wherein the support portion includes three projections that abut the leg in a state in which the leg is supported by the support portion and position the lens member in a direction of an optical axis, and wherein the three projections are positioned relative to one another such that at least a portion of the light source lies in an extension range of a triangle with vertices given by the three projections.

2. The vehicle lamp according to 1, wherein the light source includes a light-emitting surface, wherein the lens member includes a lens portion that refracts light from the light source disposed in a lamp chamber and illuminates the front of the lamp with the light, and wherein the lens portion opposes the light-emitting surface.

3. The vehicle lamp according to 1 or 2, wherein the lens member includes three projection-receiving surfaces which the three projections abut, and wherein portions at which the projections abut the respective projection-receiving surfaces are at an equal distance in the direction of the optical axis from a predetermined reference point that determines a position of the light source relative to the light-source stage.

4. The vehicle lamp according to any one of 1 through 3, wherein the light-source stage includes one of a first positioning mechanism and a second positioning mechanism that engage with each other in a state in which the leg is supported by the support portion, wherein the lens member includes the other one of the first positioning mechanism and the second positioning mechanism provided on the leg, wherein the first positioning mechanism is a positioning pin, wherein the second positioning mechanism is a positioning hole into which the positioning pin is inserted, and wherein, as the first positioning mechanism and the second positioning mechanism engage with each other, the light-source stage and the lens member are positioned in a plane direction orthogonal to the direction of the optical axis of the vehicle lamp.

5. The vehicle lamp according to any one of 1 through 4, wherein the light-source stage is a lamp body that constitutes an outer shape of the vehicle lamp, and wherein the lens member is an outer cover that, along with the lamp body, constitutes the outer shape of the vehicle lamp.

In addition, the following configurations may also be encompassed within the scope of the present invention.

6. A vehicle lamp, comprising:

a lamp body having an opening; and a translucent outer cover that covers the opening and that, along with the lamp body, forms a lamp chamber, wherein the lamp body includes one of a groove and an engagement portion to be inserted into the groove provided along the opening, wherein the outer cover includes:

a lens portion that refracts light from a light source disposed in the lamp chamber and that illuminates a front of the lamp with the light; and a leg that extends from a periphery of the lens portion toward the lamp body and that includes the other one of the groove and the engagement portion provided at an end thereof, wherein the lamp chamber is sealed as the engagement portion is inserted into the groove, wherein the lamp body includes one of a first positioning mechanism and a second positioning mechanism that engage with each other in a state in which the engagement portion is inserted in the groove, and wherein the outer cover includes the other one of the first positioning mechanism and the second positioning mechanism provided on the leg.

7. The vehicle lamp according to 6, wherein the first positioning mechanism is a positioning pin, wherein the second positioning mechanism is a positioning hole into which the positioning pin is inserted, and wherein, as the first positioning mechanism and the second positioning mechanism engage with each other, the lamp body and the outer cover are positioned in a plane direction orthogonal to a direction of an optical axis of the vehicle lamp.

8. The vehicle lamp according to 7, wherein the lamp body includes one of a projection that projects in the direction of the optical axis of the vehicle lamp and a projection-receiving surface against which the projection abuts in a state in which the engagement portion is inserted in the groove, wherein the outer cover includes the other one of the projection and the projection-receiving surface, and wherein, as the projection abuts against the projection-receiving surface, the lamp body and the outer cover are positioned in the direction of the optical axis.

9. The vehicle lamp according to 8, wherein a plurality of projections and a plurality of projection-receiving surfaces are provided, and wherein portions at which the projections abut the respective projection-receiving surfaces are at an equal distance in the direction of the optical axis from a predetermined reference point that determines a position of the light source relative to the lamp body.

10. The vehicle lamp according to any one of 6 through 9, wherein at least two first positioning mechanisms and at least two second positioning mechanisms are provided, and wherein the first positioning mechanisms are disposed at an equal distance from the predetermined reference point that determines the position of the light source relative to the lamp body in a second direction that is orthogonal to a direction orthogonal to the direction of the optical axis of the vehicle lamp.

11. The vehicle lamp according to 10, wherein the first positioning mechanisms are disposed such that the reference point lies on a straight line connecting the two first positioning mechanisms.

What is claimed is:

1. A vehicle lamp, comprising:

a light source;

a metal light-source stage including a light-source mounting portion; and a lens member that emits light from the light source toward a front of the lamp, wherein the light-source stage includes a support portion for the lens member, wherein the lens member includes a leg projecting toward the light-source stage and having an end that is supported by the support portion, wherein the support portion includes three projections that abut the leg in a state in which the leg is supported by the support portion and that position the lens member in a direction of an optical axis, wherein the three projections are positioned relative to one another such that at least a portion of the light source lies in an extension range of a triangle with vertices given by the three projections, and wherein the light-source stage diffuses heat emitted by the light source.

2. The vehicle lamp according to claim 1, wherein the light source includes a light-emitting surface, wherein the lens member includes a lens portion that refracts light from the light source disposed in a lamp chamber and illuminates the front of the lamp with the light, and wherein the lens portion opposes the light-emitting surface.

3. The vehicle lamp according to claim 1, wherein the lens member includes three projection-receiving surfaces which the three projections abut, and wherein portions at which the projections abut the respective projection-receiving surfaces are at an equal distance in the direction of the optical axis from a predetermined reference point, which determines a position of the light source relative to the light-source stage.

4. The vehicle lamp according to claim 1, wherein the light-source stage includes one of a first positioning mechanism and a second positioning mechanism that engage with each other in a state in which the leg is supported by the support portion, wherein the lens member includes the other one of the first positioning mechanism and the second positioning mechanism provided on the leg, wherein the first positioning mechanism is a positioning pin, wherein the second positioning mechanism is a positioning hole into which the positioning pin is inserted, and wherein, as the first positioning mechanism and the second positioning mechanism engage with each other, the light-source stage and the lens member are positioned in a plane direction orthogonal to the direction of the optical axis of the vehicle lamp.

5. The vehicle lamp according to claim 1, wherein the light-source stage is a lamp body that constitutes an outer shape of the vehicle lamp, and wherein the lens member is an outer cover that, along with the lamp body, constitutes the outer shape of the vehicle lamp.

* * * * *